United States Patent [19]

Landis

[11] 4,155,924

[45] * May 22, 1979

[54] QUALITY IMPROVEMENT PROCESS FOR ORGANIC LIQUID

[75] Inventor: Joel V. Landis, Houston, Tex.

[73] Assignee: Petrolite Corporation, St. Louis, Mo.

[ * ] Notice: The portion of the term of this patent subsequent to Jul. 18, 1995, has been disclaimed.

[21] Appl. No.: 761,741

[22] Filed: Jan. 24, 1977

[51] Int. Cl.[2] ..... C11B 3/10; C11B 3/16

[52] U.S. Cl. ..... 260/409; 204/186; 210/39; 210/243; 260/427

[58] Field of Search ..... 210/28, 39, 51, 52, 210/53, 54, 70, 73 R, 75, 243; 426/254, 257, 271, 417, 442, 487, 488; 204/186, 188, 189, 190, 191, 302, 308; 260/420, 425, 426, 427, 428, 409

[56] References Cited

U.S. PATENT DOCUMENTS

| | | | |
|---|---|---|---|
| 2,288,441 | 6/1942 | Ewing | 210/28 |
| 2,314,621 | 3/1943 | Kelley | 210/28 |
| 2,578,670 | 12/1951 | Carleton | 426/417 |
| 2,746,867 | 5/1956 | Werly | 426/417 |
| 3,870,807 | 3/1975 | Baltes | 426/417 |
| 3,933,643 | 1/1976 | Colvin et al. | 210/243 |
| 4,040,926 | 8/1977 | Oberton | 204/308 |
| 4,049,520 | 9/1977 | Wagner | 204/186 |

FOREIGN PATENT DOCUMENTS

| | | | |
|---|---|---|---|
| 457718 | 5/1973 | U.S.S.R. | 210/28 |

*Primary Examiner*—Charles N. Hart
*Assistant Examiner*—Ivars Cintins
*Attorney, Agent, or Firm*—Sidney B. Ring; Hyman F. Glass

[57] ABSTRACT

A process for the quality improvement of a nonpetroleum organic liquid (fats, animal and vegetable oils) containing color bodies, moisture and alkali soaps as impurities. The organic liquid is subjected to (1) a refining step using an aqueous alkali reagent, (2) admixing with the organic liquid of a finely dispersed solid adsorbent, (3) elevated temperatures dehydrating and deareating the mixture of the organic liquid and dispersed solid adsorbent, and (4) electrofiltration of the mixture of organic liquid and solid adsorbent to provide a solids-free, soaps-free quality improved organic liquid which is passed to a subsequent utilization (e.g., hydrogenation, deodorization, etc.). Electrofiltration is conducted in an atmosphere substantially devoid of oxygen-containing gases and moisture.

21 Claims, 1 Drawing Figure

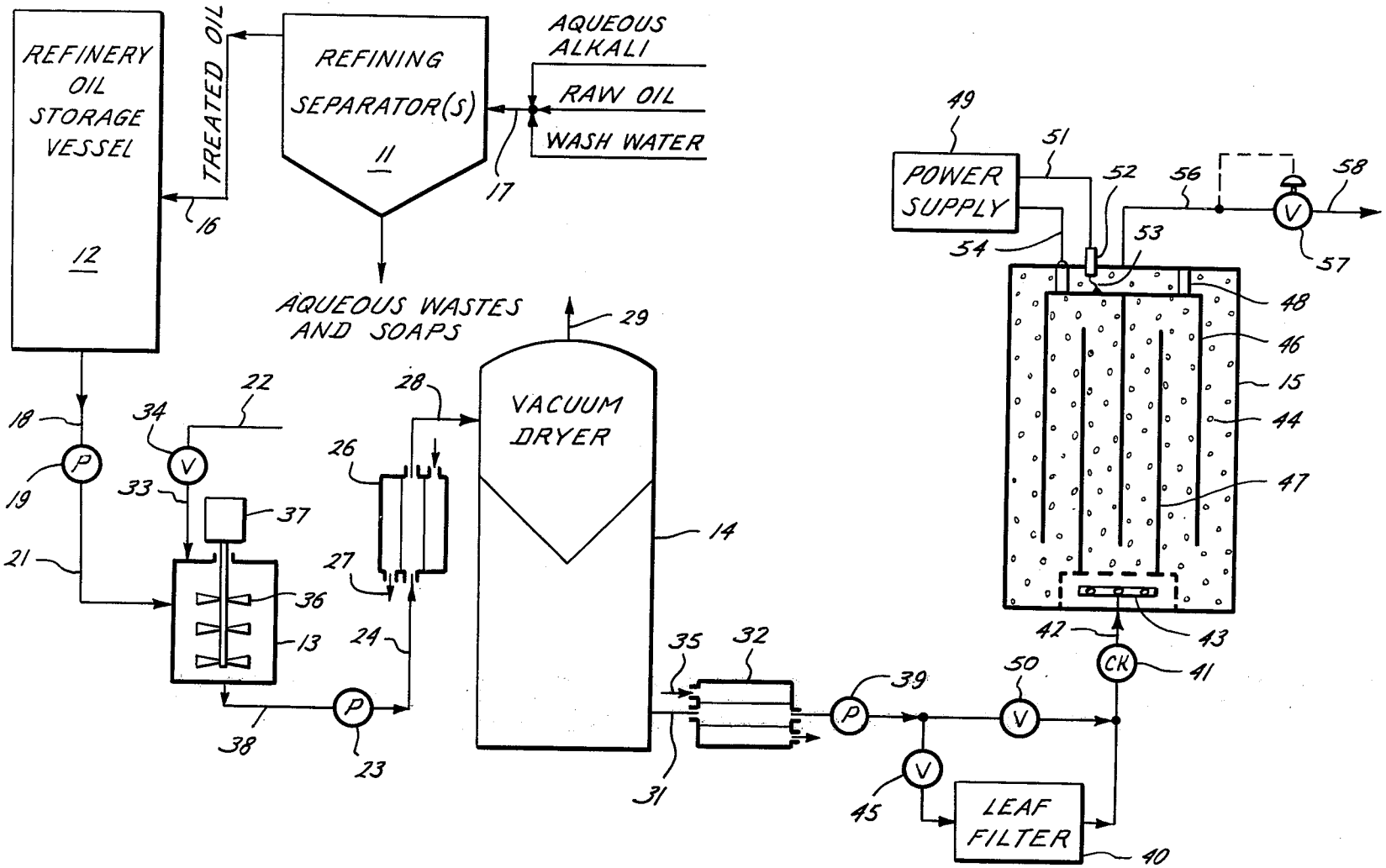
AQUEOUS ALKALI
RAW OIL
WASH WATER
REFINING SEPARATOR(S) 11
AQUEOUS WASTES AND SOAPS
TREATED OIL
REFINERY OIL STORAGE VESSEL 12
VACUUM DRYER
POWER SUPPLY
LEAF FILTER
CK
P
V

QUALITY IMPROVEMENT PROCESS FOR ORGANIC LIQUID

BACKGROUND OF THE INVENTION

1. Field of the Invention

This invention relates to the processing of a nonpetroleum organic liquid such as fats, animal and vegetable oils; and more particularly to the quality improvement (solids, soaps. etc.) of such an organic liquid by a multistep treating process.

2. Description of the Prior Art

Many nonpetroleum organic liquids (e.g., fats, vegetable and animal oils) are used for human consumption and other utilizations. The organic liquid can be purified chemically and mechanically to remove solids and to improve chemical properties, color, odor and enchance storage stability, to make it more suitable for ultimate utilization. Present day treatment of crude fat, animal and vegetable oils, as organic liquids, consist generally of the steps of refining, bleaching, and deodorization, as well as hydrogenation and winterizing. The term "refining" refers to any purification treatment designed to remove undesired materials such as free fatty acids, phosphatides, or mucilaginous material, or other gross impurities in the organic liquid. The term "bleaching" is reserved for treatment designed solely to reduce the color of organic liquid. The term "deodorizing" is used for the treatment which has as its primary object to remove the traces of constituents which give rise to flavors and odors from the organic liquid.

The refining of an organic liquid usually employs aqueous reagents in the nature of alkali or acid to remove certain impurities, such as free fatty acids and certain color bodies. Also, the refining treatment can improve the color and odor characteristics of the organic liquid. For example, vegetable oils, especially those subjected to oxidization, suffer from increased color components especially the red and yellow tints. A prebleach step can be used to effect the removal of various color bodies, residual moisture and impurities such as residual soaps formed by the alkali reagent reactions. A solid adsorbent, such as bleaching clay, is admixed as a fine dispersion into the refined organic liquid, the mixture heated, dehydrated and deareated in vacuum dryers or in atmospheric tanks, and then filtered in mechanical equipment such as leaf filters. The filtered organic liquid which is an acceptable product in the industry (good color and low solids), is usually subjected to hydrogenation to provide a consumer product (e.g., shortening) or used directly for various other utilizations. For decades, the filtered organic liquid has been accepted as of proper high purity for the hydrogenation procedure.

In hydrogenation treatment, the organic liquid is admixed with a small amount of a hydrogenation catalyst in a finely dispersed state. Then, the mixture is subjected to superatmospheric hydrogen gas at elevated temperatures for a selected period of time until the desired reaction of the unsaturated and hydrogen reducible materials is reached in the organic liquid. After hydrogenation is completed, the organic liquid and the dispersed hydrogenation catalyst are separated (e.g., using precoated leaf filters). The effectiveness of the hydrogenation treatment is determined by several factors such as quality of the product in lovibond color, solids content, metals, water content, acid numbers, and so forth. The time required to reach a certain level of hydrogenation, the degree of hydrogenation in total consumption and saturation of desired unsaturate bonds in the organic liquid have a substantial weight in the economics of the hydrogenation treatment.

The industry has assumed for decades that if the organic liquid is given a proper (optimum) prebleaching treatment, the conditions of hydrogenation treatment solely determine the quality of the product organic liquid. Stated in another manner, in the proper prebleaching treatment, the purified organic liquid is filtered mechanically to optimum color and impurities quality. Then, only the hydrogenation conditions control the quality of the hydrogenated organic liquid.

In arriving at the present invention, the filtered organic liquid from mechanical filters was subjected to a unique purification step and then hydrogenated. The effectiveness of the hydrogenation treatment was increased and the quality of the hydrogenated organic liquid was also improved. Under these circumstances, the unique purification step was substituted directly for the mechanical filtration using leaf filters. Again, the unexpected increase in hydrogenation treatment effectiveness and improved product quality of the hydrogenated organic liquid were obtained. An experimental program provided data to confirm these unique results attributed to this unique purification step.

The present invention is a process which employs the unique purification step in a combination of steps familiar in everyday practices in the refining, prebleaching and hydrogenation of organic liquids. However, the resultant combination of steps produces greatly improved results not obtained with conventional prebleaching treatments using mechanical filtration of the organic liquid. Furthermore, the unique purification step provides substantially complete removal of all finely divided solid materials, moisture and alkali soaps that can be considered deleterious impurities effecting hydrogenation efficiency and product quality of the hydrogenated organic liquid. It is believed that the complete removal of these impurities promotes an increased susceptibility of the organic liquid to hydrogenation.

SUMMARY OF THE INVENTION

In accordance with this invention, there is provided a process for quality improvement of nonpetroleum organic liquid from the group comprising fats, vegetable and animal oils. The process has the steps of (1) refining the organic liquid with an aqueous inorganic base forming a purified organic liquid containing moisture and residual soaps formed by the aqueous inorganic base, (2) mixing this purified organic liquid with a finely divided solid adsorbent, (3) at elevated temperatures and subatmospheric pressure conditions, dehydrating and deareating this mixture of the purified organic liquid and dispersed solid adsorbent, and (4) subjecting this mixture to electrofiltration with or without prior mechanical filtration for substantially complete removal of the dispersed solid adsorbent from the purified organic liquid, thereby providing a solids-free, soaps-free and quality improved organic liquid for subsequent utilization. The steps of electrofiltration are practised in an atmosphere substantially devoid of oxygen-containing gases and moisture.

DESCRIPTION OF THE DRAWING

The drawing is a diagrammatic illustration, in flow schematic, of an arrangement of apparatus for carrying out the novel steps of the present process.

DESCRIPTION OF SPECIFIC EMBODIMENTS

The present process will be described in the purification of one type of organic liquid, namely soybean oil. However, it will be appreciated that this process is equally applicable and of utility with other types of organic liquids, e.g., fats, and animal and vegetable oils. There is shown in the drawing an arrangement of apparatus for practising the steps involved in the present process. However, other arrangements of apparatus which are capable of carrying out the listed steps, by direct or equivalent functions, can be employed with equal effect for refining and prebleaching treatments. More particularly, the steps for refining the oil are conducted in one or more refining separator(s) 11, an oil storage vessel 12, a mixer 13, one or more vacuum dryers 14, and a leaf filter 40.

The separator 11 receives a charge of raw oil through an inlet 17 to which is added in admixture an aqueous reagent immediately prior to its entry into the separator. For example, the aqueous reagent may be alkali or acid material. Usually, the aqueous reagent is a relatively weak alkali such as caustic of 5% by weight concentration. The separator 11 can function as a second or water washing stage. For this purpose, water is added to the priorly alakli treated raw oil. The aqueous reagent converts certain impurities in the raw oil into an aqueous phase form where they are separated by gravity or centrifugal force from the refining oil and removed as aqueous wastes and soaps as an underflow from the separator 11.

The aqueous wastes from the separator 11 are sent to a suitable disposal facility wherein the removed impurities, such as alkali metal salts, are recovered or suitably disposed. The refined or purified oil from the separator 11 is sent through an outlet 16 into the oil storage vessel 12. As needed, the purified oil is removed from the vessel 12 through outlet 18 by a suitable pump 19.

The purified oil contains various impurities such as finely dispersed solid materials, moisture, residual soaps from prior alkali reagent reactions, metals, catalyst poisons, etc. The purified oil is moved (in regulated flow or selected batches) by the pump 19 for introduction into inlet 21 of the mixer 13. The mixer 13 also receives a proper charge of solid adsorbent (e.g., 0.1 to 3%) that is introduced through an inlet 33 and control valve 34. More particularly, in either batch or continuous operation, a sufficient amount of the solid adsorbent is added to the purified oil so that the impurities are removed by adsorption in a large degree.

The mixer 13 provides for the dispersion of solid adsorbent at relative constant concentration within the purified oil. For this purpose, the mixer 13 includes a shaft carrying a plurality of mixing paddles 36 rotated by prime mover 37 which may comprise an electric motor carrying an integral gear box. The resultant admixture of oil and solid adsorbent is passed by a pump 23 through a heat exchanger 26 wherein a hot fluid in jacket inlet 27 raises the oil temperature to at least about 150° F.

The solid adsorbent can be selected from the group of materials employed in the conventional prebleaching of organic liquid. Examples of the solid adsorbents include spent hydrogenation catalyst, bleaching clay in both acid activated and natural forms, fuller's earth, diatomaceous earth, activated carbon and kieselguhr. Of a special utility in prebleaching of soybean, peanut, corn, cottonseed, palm and safflower oils, the acid-activated bleaching clays provide good results. Non-activated bleaching clay can be used with coconut and palm kernel oils. Certain of the solid adsorbents are obviously of greater utility than others depending upon the particular type of oil and its prior treatment employed in the edible oil industry. Subject to the particular oil and the impurities it contains, some variation in type and amounts of the solid adsorbent can be made for the effective removal of these impurities. An effective amount of the solid adsorbent should be used. Generally, more than about 0.01% by weight of the solid adsorbent must be introduced in admixture into the oil. Usually, the solid adsorbent is used in amounts about 0.1 to about 3.0 by weight.

The heated mixture of solid adsorbent and oil flows from the heat exchanger 26 into the inlet 28 of a vacuum dryer 14. Under subatmospheric pressure conditions (e.g., 10 inches water pressure), the mixture is dehydryated and deaerated with the gaseous phase being removed through a suction vent 29 for proper disposal or reuse. If desired, a second stage of heating and vacuum dryer treatment (flash bleaching) can be used. In many cases, the best results are obtained when the mixture of oil and solid adsorbent are heated to between 150° F. and 240° F. before entry into the vacuum dryer stage.

The dehydrated and deaerated oil leaves the vacuum dryer 14 through outlet 31 and can be sent through an economizer or heat exchanger 32 wherein a jacket inlet 35 carries a fluid for heat recovery purposes. Generally, the mixture from the heat exchanger 32 may have a lowered temperature in the range of 150° F. to 200° F.

In the past, the mixture from the heat exchanger 32 was sent by a pump 39 through mechanical filtration equipment such as leaf filters 40. The product oil was of good color and had a very low solid material, moisture and soap content. For decades, this mechanically filtered oil was accepted as the properly prepared charge for hydrogenation. However, the unique purification step of the present invention applied after, or as a substitute for, mechanical filtration produces a vastly superior refined oil as the charge for hydrogenation.

In this regard, the heated oil and solid adsorbent mixture is moved by the pump 39 into inlet 42 of a novel electrofilter 15. The electrofilter 15 can be used after mechanical filtration, or in substitue therefor through adjustment of block valves 45 and 50. In either arrangement, the same unexpected results in increased hydrogenation effectiveness and improved quality of hydrogenated oil are obtained.

The electrofilter 15 receives the admixed oil and solid adsorbent under superatmospheric pressure and in an atmosphere substantially devoid of oxygen-containing gases and moisture. Removal of oxygen-containing gases and moisture by the vacuum dryer 14 produces a dry deaerated oil, and this condition is preserved on passage of the oil into the electrofilter 15.

The electrofilter 15 has a pressure vessel containing a porous particulate bed disposed in an intense electrical field so that solid impurities in the oil are removed by their induced adherence to the particulate bed. The electrofilter 15 has a metal vessel with an inlet 42 and outlet 56 and contains a suitable particulate solid material 44 completely filling its interior. The electrofilter 15 receives preferably a continuous and uniform flow of the admixture flowing through an inlet 42 into a distributor 43 provided by pipe cross arms containing metering openings. The interior of the vessel contains a plurality of energized electrodes 46 in spaced relationship to a plurality of grounded electrodes 47. Preferably, the electrodes 46 and 47 are vertically elongated metal tubes and have substantial overlapping dimensions defining an electric field within the particulate material 44. The electrodes 46 are suspended from the vessel by insulators 48. In addition, the electrodes 46 are energized by an external power supply 49 providing a high intensity potential through a conductor 51, an entrance bushing 52 and a flexible lead 53 to the electrodes 46. The power supply 49 can be grounded to the vessel by conductor 54.

The electrofilter 15 applies the high intensity electric field to induce the tenaceous adhesion of the solid adsorbent and finely divided impurities upon the particulate material 44. It is preferred that the power supply 49 provides a high intensity d.c. electric field within the particulate material 44 contained within the electric field defined by the electrodes 46 and 47. Preferably, the electric field produces a potential gradient in the particulate material 44 of about not less than 20 kilovolts per inch. A certain type of particulate material 44 should be employed for optimum results. Preferably, the material 44 is composed of rigid solid particles having a relatively low dielectric constant (below about 6). More particularly, this particulate material is chemically inert, incompressible, hard granular and rigid in nature. The particulate material can be a solid mineral containing crystalline silicon dioxide such as flint, garnet, granite and fused quartz. Preferably, the mineral is crushed to provide non-spheroidal configurations which have relatively discontinuous surfaces. For example, crushed flint rock having particle sizes of its minimum dimensions between $\frac{1}{8}$ and $\frac{1}{2}$ inch are employed to good advantage in the present process.

The electrofilter 15 produces, for practical purposes, the substantially complete removal of the solid adsorbent, moisture, residual soaps, catalyst poisons, and metal contaminates, as the oil passes from the inlet 42 through the bed material 44 to the outlet 56. As a result, the oil removed through the outlet 56 is moisture-free, solids-free and soaps-free quality improved. The product oil flows through a backpressure valve 57 which is set to maintain a desired superatmospheric pressure. The product oil is carried through a conduit 58 to a subsequent utilization, as for example, consumer product or more commonly, to subsequent hydrogenation.

In the hydrogenation treatment, the product oil is mixed with a small amount of metal hydrogenation catalyst and subjected to hydrogen gas at elevated temperature and pressure conditions for sufficient time that a certain hydrogenation effectiveness and improved quality oil is obtained. Several pilot plant tests were made using the apparatus of the drawing in a commercial facility, but with a reduced scaled electrofilter unit.

TESTS

A comparison was made on three fifteen gallon samples for hydrogenation effectiveness and quality of hydrogenated product oil using the apparatus of the drawing. The oil from mechanical leaf filters and unfiltered oil were both purified in the electrofilter and then hydrogenated in a pilot plant sized converter. One sample was coconut oil and two samples were soybean oils. The hydrogenation effectiveness rate is monitored by refractive index numbes (RN) and percentage difference in rate is calculated as:

$$\% \text{ Rate Difference (PND)} = \frac{\text{Electrofiltered Oil Rate-Leaf Filtered Oil Rate}}{\text{Leaf Filtered Oil Rate}} \times 100$$

Data was tabulated at uniform time intervals until hydrogenation completeness.

Coconut Oil: In the first ten minutes of hydrogenation the PND was 112.5 and at the end of 70 minutes the PND was 303.4 and the RN changed from 65 to 68.4. Further, the electrofiltered oil continued to be hydrogenated for a total of 130 minutes (but for only a slight additional increase (0.6) of refractive index number).

Soybean Oils I and II: The total refractive index number change was from 3.6 to 32 RN reflecting the hydrogenation effectiveness. The electrofiltered oil, however, was hydrogenated completely in five minutes less time (total 70 minutes) and had a PND of 32.5 and 26.1 for the Oils I and II, respectively.

In both the coconut and soybean oils, the effectiveness of hydrogenation (the change of RN per unit time) was more uniform throughout the hydrogenation period for electrofiltered oil as compared to oil merely mechanically filtered. Although the mechanically filtered oil appeared clean, it had appreciable amounts of metals (e.g., 3–10 ppm) whereas the electrofiltered oil was free of all solid materials including metals and solid impurities. The greater effectiveness in hydrogenation of the electrofiltered oil from prebleaching is attributed to the absence of any amounts ($\geqq 1$ ppm) of solid materials (bleaching clays, metals, etc.) and impurities such as moisture, residual alkali metal soaps and other possible solid materials that might be poisons or reaction retardants to hydrogenation catalysts and reactions. The exact reason for the results in the use of electrofiltration are not known beyond the above statement.

Also, the hydrogenated product of the electrofiltered oil from prebleaching has a superior "bright" clear color (10 filters impurities disc test), no metal contaminates, very low solids content and better product quality (appearance, stability, etc.). The oil and bleaching clay mixture was passed through a small electrofilter (1 foot in diameter) having crushed flint rock (Flintbrasive No. 11) in an electrical field having a gradient of about 20 kv/in., d.c.

It will be apparent that there has been provided a process well adapted for improving the quality of organic liquids. The present process is completely compatible with conventional operations in the food industry, or other places, where organic liquids are purified. It is to be understood that certain features and alternations of the present process may be employed without departing from the spirit of this invention. This variation is contemplated by, and is within, the scope of the appended claims. It is intended that the foregoing description is to be taken as an illustration of the present process.

What is claimed is:

1. A process for the quality improvement of an unhydrogenated non-petroleum organic liquid selected from the group of fats, animal and vegetable oils, which comprises the step of subjecting to electrofiltration a dry deaerated mixture of (1) said unhydrogenated nonpetroleum organic liquid which has beem treated with aqueous inorganic base and (2) a finely dispersed solid adsorbent adapted to remove color bodies, moisture, residual soaps and like materials formed in said treatment with aqueous inorganic base, said electrofiltration being carried out by passing said mixture in an atmosphere devoid of oxygen-containing gases and moisture through a porous particulate bed disposed in a d.c. electric field of intensity sufficient to cause solid impurities to be removed by their adherence to the particulate bed and of potential gradient not less than about 20 kilovolts per inch, the particulate materials being inert rigid solid particles of dielectric constant below about 6, so as to reduce the solids content of said mixture.

2. A process for the quality improvement of a nonpetroleum organic liquid selected from the group of fats, animal and vegetable oils, wherein the organic liquid is an unhydrogenated organic liquid comprising:

(a) refining the organic liquid with an aqueous inorganic base in a purification treatment thereby producing a purified organic liquid and an aqueous phase containing impurities present in the organic liquid and separating the aqueous phase from the purified organic liquid;

(b) forming a mixture with the purified organic liquid and a finely dispersed solid absorbent adapted to remove color bodies, moisture and residual soaps and like materials formed by the aqueous inorganic base in said treatment;

(c) dehydrating and deaerating under subatmospheric pressure conditions the purified organic liquid and the finely dispersed solid adsorbent mixture at elevated temperatures sufficient to facilitate such dehydrating and deaerating;

(d) in an atmosphere substantially devoid of oxygen-containing gases and moisture subjecting the mixture of step (c) to electrofiltration for the substantially complete removal of the dispersed solid adsorbent from the purified organic liquid thereby providing a solids-free and soaps-free quality improved organic liquid, said electrofiltration being carried out by passing said mixture in an atmosphere devoid of oxygen-containing gases and moisture through a porous particulate bed disposed in a d.c. electric field of intensity sufficient to cause solid impurities to be removed by their induced adherence to the particulate bed and of potential gradient not less than about 20 kilovolts per inch, the particulate materials being inert rigid solid particles of dielectric constant below about 6, so as to reduce the solids content of said mixture; and (e) passing the quality improved organic liquid to a subsequent utilization.

3. The process of claim 2 wherein said solid adsorbent is selected from the group consisting of spent hydrogenation catalyst, bleaching clay, fuller's earth, diatomaceous earth, activated carbon and kieselguhr.

4. The process of claim 2 wherein the quality improved organic liquid is subjected to hydrogenation in the presence of a hydrogenation catalyst and hydrogen gas at elevated temperature to facilitate hydrogenation and superatmospheric pressure conditions.

5. The process of claim 2 wherein said solid adsorbent is bleaching clay and is admixed with the purified organic liquid in an amount between about 0.1 and about 3.0 weight percent.

6. The process of claim 2 wherein said solid adsorbent is acid-activated bleaching clay added to the purified organic liquid in amounts sufficient to remove substantially completely color bodies and moisture amounts.

7. The process of claim 6 wherein the organic liquid is refined in step (a) with an aqueous alkali reagent.

8. The process of claim 2 wherein the organic liquid is soybean oil that is refined in step (a) with an aqueous alkali reagent and the solid adsorbent admixed in step (c) is acid-activated bleaching clay.

9. The process of claim 2 wherein the electrofiltration in step (d) is provided by a bed of dielectric particulate solids interposed within an electrical field having a sufficient intensity that the dispersed solid absorbent in substantial totality adheres to the particulate solids in the bed traversed by the organic liquid.

10. The process of claim 9 wherein the bed has particulate solids of a chemically inert, incompressible, hard granular and rigid nature with a non-spheroidal configuration.

11. The process of claim 10 wherein the particulate solids are a mineral containing crystalline silicon dioxides.

12. The process of claim 11 wherein the mineral is flint, garnet, granite or fused quartz.

13. The process of claim 2 wherein the purified organic liquid that has been treated with the aqueous inorganic base is subjected to step (b) without an intervening water washing stage.

14. A process for the quality improvement of a nonpetroleum unhydrogenated organic liquid from the group of fats, animal and vegetable oils comprising:

(a) refining the organic liquid with aqueous alkali reagent in a purification treatment thereby producing a purified organic liquid and an aqueous phase containing impurities present in the organic liquid and separating the aqueous phase from the purified organic liquid;

(b) forming a mixture of the purified organic liquid and a finely dispersed solid adsorbent adapted to remove color bodies, moisture and residual soaps formed by the aqueous alkali reagent;

(c) heating the mixture of purified organic liquid and dispersed solid adsorbent to an elevated temperature of at least 150° F.;

(d) dehydrating and deaerating under subatmospheric pressure conditions the heated mixture of purified organic liquid and dispersed solid absorbent;

(e) in an atmosphere substantially devoid of oxygen-containing gases subjecting the heated dehydrated and deaerated mixture produced in step (d) to electrofiltration for the substantially complete removal of the dispersed solid adsorbent from the organic liquid thereby providing a solids-free and soaps-free improved organic liquid, said electrofiltration being carried out by passing said mixture in an atmosphere devoid of oxygen-containing gases and moisture through a porous particulate bed disposed in a d.c. electric field of intensity sufficient to cause solid impurities to be removed by their induced adherence to the particulate bed and of potential gradient not less than about 20 kilovolts per inch, the particulate materials being inert rigid solid particles of dielectric constant below about 6; and (f) hydrogenating the solids-free, soaps-free improved organic liquid in the presence of hydrogen gas and a finely divided hydrogenation catalyst at elevated temperature to facilitate hydrogenation.

15. The process of claim 14 wherein said solid adsorbent is selected from the group consisting of spent hydrogenation catalyst, bleaching clay, fuller's earth, diatomaceous earth, activated carbon and kieselguhr.

16. The process of claim 14 wherein the solid adsorbent is acid activated bleaching clay and the organic liquid is selected from the group consisting of soybean, peanut, corn, cottonseed, palm and safflower oils.

17. The process of claim 14 wherein the solid adsorbent is bleaching clay and is admixed with the purified organic liquid in an amount between about 0.1 and about 3.0 weight percent.

18. The process of claim 14 wherein said solid adsorbent is dispersed within the purified organic liquid in amounts between 0.1 to 3.0 percent by weight.

19. The process of claim 14 wherein the mixture of organic liquid and dispersed solid adsorbent is dehydrated and deareated in step (d) at temperatures between 150° F. and 240° F.

20. The process of claim 14 wherein the solid adsorbent admixed in step (b) is non-activated bleaching clay and the organic liquid is selected from the group consisting of coconut and palm kernel oils.

21. The process of claim 14 wherein the purified organic liquid that has been treated with the aqueous alkali reagent is subjected to step (b) without an intervening water washing step.

* * * * *